US012276468B2

(12) United States Patent
Murray et al.

(10) Patent No.: US 12,276,468 B2
(45) Date of Patent: Apr. 15, 2025

(54) FIREARM SOUND SUPPRESSOR

(71) Applicant: SilencerCo Weapons Research, LLC, West Valley City, UT (US)

(72) Inventors: Brent Edward Murray, Herriman, UT (US); Jonathon Mccarn Shults, Alpine, UT (US)

(73) Assignee: SilencerCo Weapons Research, LLC, West Valley City, UT (US)

( * ) Notice: Subject to any disclaimer, the term of this patent is extended or adjusted under 35 U.S.C. 154(b) by 0 days.

(21) Appl. No.: 18/215,793

(22) Filed: Jun. 28, 2023

(65) Prior Publication Data

US 2024/0003645 A1 Jan. 4, 2024

Related U.S. Application Data

(60) Provisional application No. 63/357,876, filed on Jul. 1, 2022.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/32; F41A 21/325; F41A 21/34
See application file for complete search history.

(56) References Cited

U.S. PATENT DOCUMENTS

| | | | | |
|---|---|---|---|---|
| 918,784 | A | 4/1909 | Snow | |
| 5,110,145 | A | 5/1992 | Stewart | |
| 6,948,415 | B2 | 9/2005 | Matthews et al. | |
| 7,237,467 | B1 | 7/2007 | Melton | |
| 7,587,969 | B2 | 9/2009 | Silvers | |
| 7,588,122 | B2 | 9/2009 | Brittingham | |
| 7,856,914 | B2 | 12/2010 | Shults et al. | |
| 7,874,238 | B2 | 1/2011 | Silvers | |
| 8,162,100 | B2 * | 4/2012 | Shults | F41A 21/30 89/14.4 |
| 2006/0060076 | A1 | 3/2006 | Dueck et al. | |
| 2008/0271944 | A1 | 11/2008 | Brittingham | |
| 2009/0050403 | A1 | 2/2009 | Brittingham | |

* cited by examiner

*Primary Examiner* — J. Woodrow Eldred
(74) *Attorney, Agent, or Firm* — Holland & Hart LLP

(57) ABSTRACT

A firearm accessory may include an elongate body having an end that is positioned adjacent to a firing end of a barrel of a firearm. The firearm accessory may also include a piston assembly that is located at least partially within the elongate body. A first end of the piston assembly may be configured to be secured to the barrel of the firearm. The piston assembly may also include an indexing ring positioned at a second end of the piston assembly. The elongate body and the piston assembly may be rotatable relative to one another about a longitudinal axis that extends from the first end of the piston assembly to the second end of the piston assembly. The firearm accessory may also include an orientation assembly that includes a pawl and a selector component for selectively disengaging the pawl with the indexing ring of the piston assembly.

20 Claims, 8 Drawing Sheets

FIREARM SOUND SUPPRESSOR

CROSS-REFERENCE

The present application for Patent claims the benefit of U.S. Provisional Patent Application No. 63/357,876 by Murray et al., entitled "FIREARM SOUND SUPPRESSOR," filed Jul. 1, 2022, which is assigned to the assignee hereof, and which is expressly incorporated by reference in its entirety herein.

TECHNICAL FIELD

The following relates generally to firearms, including firearm sound suppressors.

BACKGROUND

A suppressor may be attached to a firearm to reduce the sound of the firearm. The suppressor may have an internal volume to capture exhausting gases emitted from the firearm, where the exhausting gases may be cooled before the exhausted gases are released to the atmosphere. The suppressor may also include baffles that are used to deflect the exhausting gases, slowing down the exhausting gases and dissipating the kinetic energy into the larger surface of the internal volume. Slowing the exhausting gases may reduce the sound caused by firing the firearm.

DETAILED DESCRIPTION

After a suppressor is attached to a firearm, the suppressor may be positioned in an undesirable orientation. In some examples, an orientation assembly in the suppressor may be used to selectively enable an elongate body (which may be referred to as an exterior housing) of the suppressor to rotate such that the orientation of the suppressor may be moved to a desired orientation while a piston assembly of the suppressor remains fixedly attached to the firearm. In some examples, the orientation assembly may include a cam lever and a brake that interacts with an indexing ring to selectively prevent the elongate body from rotating relative to the piston assembly.

Although the cam lever and brake configuration may be used to selectively prevent the elongate body from rotating relative to the piston assembly, in some examples, urging the brake into contact with and releasing the brake from the outer surface of the indexing ring may require excessive force from a user. Also, in some examples, the brake may unintentionally release from the outer surface of the indexing ring, among other issues. Accordingly, in some examples, the elongate body may undesirably and unexpectedly rotate relative to the piston assembly during use of the suppressor.

To facilitate an ability of a user to selectively lock the rotation of the elongate body while extending the life and performance of the locking action, a novel configuration for the orientation assembly may be used. The novel configuration of the orientation assembly may include one or more pawls that can be selectively engaged with the outer surface of the indexing ring by toggling a selector component, such as a button or selector wheel.

Figure 1:
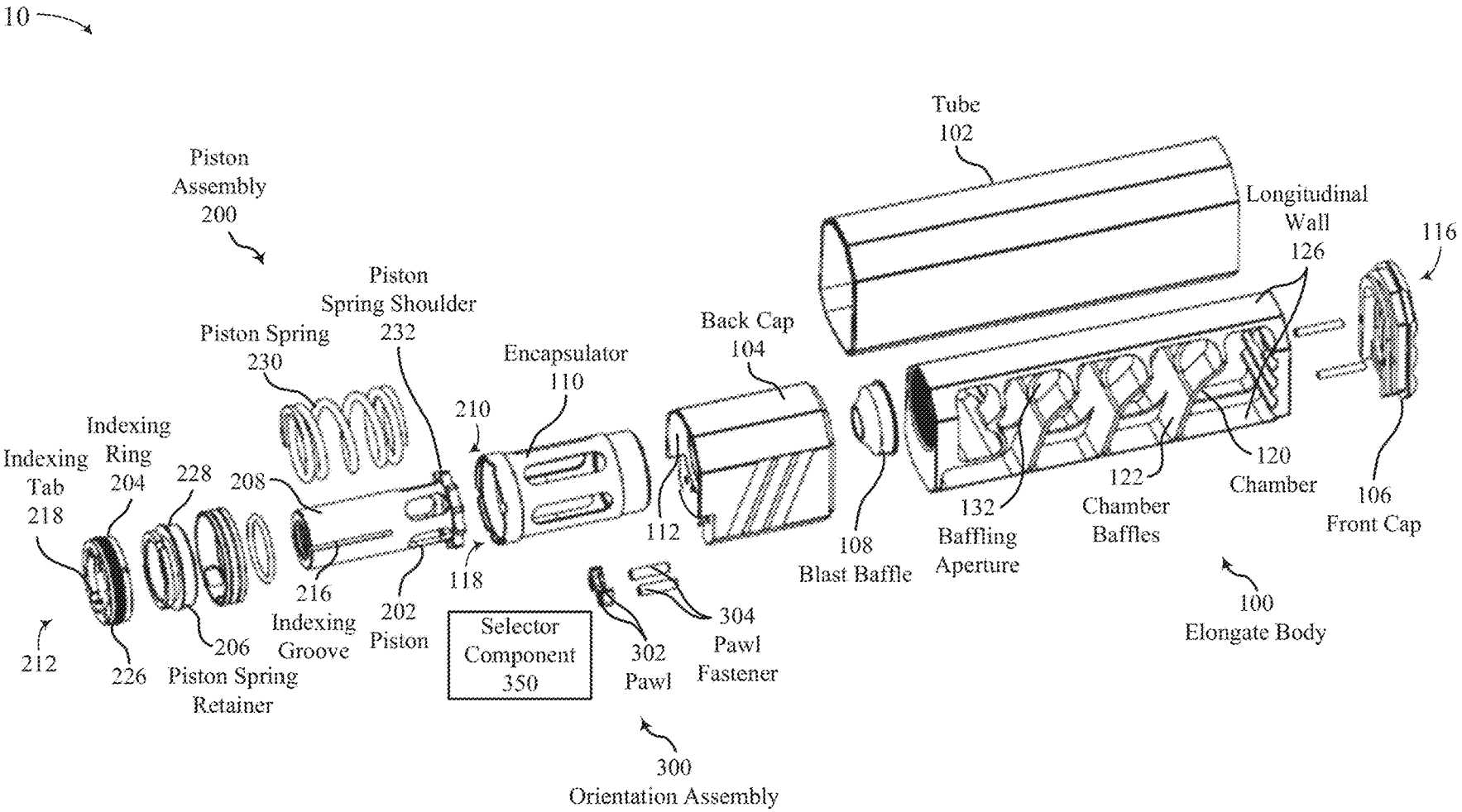
FIG. 1 shows an example of a suppressor in accordance with examples as disclosed herein.

FIG. 1 shows an example of a suppressor in accordance with examples as disclosed herein.

The suppressor 10 may be configured to attach to the muzzle of a firearm such that a bullet pathway $P_B$ through the suppressor 10 is substantially co-axially aligned with the trajectory of the bullet as it exits the muzzle of the firearm. When the bullet exits the muzzle, it exits along with high velocity discharge gases that, in normal operation, exit the muzzle rapidly, causing a loud noise. Noise suppressors, such as the one presented, may dissipate the discharge gases that exit the muzzle of a firearm to reduce the level of noise being emitted. In the present suppressor 10, these discharge gases are dissipated via the adjacent chambers 120. The adjacent chambers 120 may be configured to be in fluid communication with each other via a fluid pathway.

In some examples, at least a portion of the suppressor 10 is formed from a metal, such as aluminum. However, other materials are also contemplated, such as, for example and not meant to be limiting, alloy steel, titanium, stainless steel, carbon fiber, other reinforced composite materials, and the like.

A cross-sectional view of the outer surface of the suppressor 10 can be substantially octagonal, according to one aspect. However, the suppressor 10 can have other cross-sectional shapes as well, such as substantially circular, substantially rectangular, substantially oval, and the like. In one aspect, the cross-sectional shape can be selected to correspond to the shape of the barrel of at least one firearm and/or firearm holster. In such cases, the suppressor 10 may be holstered in a firearm holster, as a firearm would be, without requiring removal of the suppressor 10 from the firearm.

The suppressor 10 may include the elongate body 100. The elongate body 100 may have the bullet entry end 116 and the opposed bullet exit end 118. The bullet pathway $P_B$ may extend longitudinally through the elongate body 100 from the bullet entry end 116 to the opposed bullet exit end 118. The elongate body 100 may also define a plurality of adjacent chambers 120 that are spaced along a longitudinal axis $A_L$ that extends from the bullet entry end 116 to the opposed bullet exit end 118 of the elongate body 100. The bullet pathway $P_B$ may be substantially co-axially aligned with the longitudinal axis $A_L$ of the elongate body 100. Alternatively, the bullet pathway $P_B$ may be offset from the longitudinal axis $A_L$—e.g., by about 1 mm, 2 mm, 3 mm, 4 mm, 5 mm, 6 mm, 7 mm, 8 mm, 9 mm, 10 mm, 12 mm, 14 mm, 16 mm, 18 mm, 20 mm, 25 mm, 30 mm, 35 mm, 40 mm, 45 mm, 50 mm, 60 mm, 70 mm, 80 mm, 90 mm, or about 100 mm. Optionally, the bullet pathway $P_B$ can be offset from the longitudinal axis $A_L$ by at least 1 mm.

The elongate body 100 of the suppressor 10 may include a blast baffle 108 and a plurality of chamber baffles 122 separating each of the adjacent chambers 120. Each of the chamber baffles 122 may define a baffle aperture 132 that is coaxial with the bullet pathway $P_B$. In some examples, at least a portion of at least one of the chamber baffles 122 is positioned to lie in a plane that is substantially transverse to the bullet pathway $P_B$. The elongate body 100 may include at least two longitudinal walls 126 that extend from the bullet entry end 116 to the opposed bullet exit end 118. In such cases, each of the chamber baffles 122 may be connected to and supported by at least one of the longitudinal walls 126.

In some examples, at least a portion of at least one of the chamber baffles 122 may be substantially frustoconical in shape. In some examples, at least a portion of at least one of the chamber baffles 122 can be positioned at an acute angle relative to the bullet pathway $P_B$. In some examples, at least a portion of the chamber baffles 122 can be arcuate in shape. In some examples, the first baffle downstream (relative to the bullet pathway $P_B$) from the blast baffle 108 can be an arcuate "V" or "M" shape. In some examples, at least one of the chamber baffles 122 downstream from the first baffle can be substantially arcuate in shape, having a first connection point at a longitudinal wall 126 that is upstream of a second connection point relative to the bullet pathway $P_B$. It should be noted that many other shapes are contemplated for the chamber baffles 122, such as, for example and without limitation, a pyramid, a wafer, and the like.

The elongate body 100 may also include at least one of an elongate tube 102, a back cap 104, a front cap 106, and an encapsulator 110. The elongate tube 102, the back cap 104, and the front cap 106 may form a housing in which the other components of the suppressor 10 can be positioned, attached to, or both. In some examples, the back cap 104 can define the bore 112 having an inner diameter that can be threaded or otherwise configured to matingly engage the outer diameter of the piston spring retainer 206 of the piston assembly 200.

The elongate tube 102 may be configured to selectively substantially envelop the elongate body 100 and substantially enclose each of the adjacent chambers 120. The elongate tube 102 can be formed from one piece; however, it is contemplated that the elongate tube 102 can be formed from two or more pieces configured to matingly engage each other. If the elongate tube 102 is formed from two or more pieces, longitudinal edges of the pieces can be keyed to complement each other, or they may just abut one another. It is also contemplated that at least one of the pairs of longitudinal edges can comprise a hinge or similar fastening device. In some examples, the elongate tube 102 of the elongate body 100 may be configured to be easily removed so that that the deposits caused by build-up of carbon and lead from the discharge gases can readily be accessed and removed. Alternatively, the elongate tube 102 may be configured to be substantially permanently attached to the elongate body 100 to prevent a user from easily accessing internal elements of the elongate body 100.

The suppressor 10 may include the piston assembly 200. The piston assembly 200 may be rotatably coupled to the elongate body 100 adjacent the bullet entry end 116. In some examples, the piston assembly 200 is configured to fixedly, selectively attach to a distal end of a barrel of a firearm. As used herein, the terms "fixed" and "fixedly" mean substantially non-movably. For example, "fixedly attaching" the piston assembly 200 to the distal end of the barrel of a firearm means that the piston assembly 200 does not substantially move relative to the end of the barrel of the firearm after fixed attachment to the barrel of the firearm, unless the operator selectively removes the suppressor 10 from the firearm.

The piston assembly 200 may include the piston 202, the indexing ring 204, and the piston spring retainer 206. The piston 202 may include an elongate, substantially cylindrical body 208 having a piston bullet entry end 210 and a piston bullet exit end 212. In some examples, a piston bore may be defined in the cylindrical body 208 of the piston 202 and may extend from the piston bullet entry end 210 to the piston bullet exit end 212. The piston bore may be substantially coaxially aligned with the bullet pathway $P_B$. In some examples, the piston bullet entry end 210 of the piston 202 is selectively, fixedly attachable to a portion of the distal end of the barrel of the firearm. Thus, for example, at least a portion of the piston bore adjacent the piston bullet entry end 210 can be threaded such that the threads matingly engage complementary threads on the distal end of the barrel of the firearm.

In some examples, the piston 202 includes at least one longitudinal indexing groove 216 formed on an outer surface of the cylindrical body 208 of the piston 202. The at least one longitudinal indexing groove 216 may extend from the piston bullet entry end 210 towards the piston bullet exit end 212 longitudinally along at least a portion of the cylindrical body 208 of the piston 202.

The indexing ring 204 may be annular and have an inner diameter sized to correspond to an outer diameter of the piston 202, such that the indexing ring 204 fits around the piston 202 with close tolerance (e.g., within a threshold tolerance). The indexing ring 204 may be configured for coupling to the piston bullet exit end 212 of the piston 202. The inner diameter of the indexing ring 204 may have at least one longitudinal indexing tab 218 formed thereon. The at least one longitudinal indexing tab 218 may extend longitudinally from a first side of the indexing ring 204 to a second side of the indexing ring 204. Alternatively, the at least one longitudinal indexing tab 218 may extend longitudinally for a portion of the distance from the first side of the indexing ring 204 to the second side of the indexing ring 204.

If the indexing ring 204 is inserted around the piston 202 such that the at least one longitudinal indexing tab 218 of the indexing ring 204 is inserted in the at least one longitudinal indexing groove 216 of the piston 202, the indexing ring 204 may be substantially radially fixed relative to the cylindrical body 208 of the piston 202. Thus, in one aspect, the indexing ring 204 can be free to move longitudinally along the at least one longitudinal indexing groove 216 a predetermined distance, however, the indexing ring 204 can be prevented from rotating relative to the piston 202. In this manner, the indexing ring 204 can be radially fixed with respect to the piston 202. It is of course contemplated that other means for radially fixing the indexing ring 204 to the piston 202 can be used, such as a rail and slot arrangement.

The outer surface 226 of the indexing ring 204 may include one or more uneven surfaces, such as notches and/or teeth. For example, the outer surface 226 of the indexing ring 204 may be knurled. The outer surface 226 of the indexing ring 204 may be configured to engage with one or more locking ends of the pawls 302 such that rotation of the elongate body 100 may be prevented when the outer surface 226 of the indexing ring 204 is engaged with the locking ends of the pawls 302 (which may be linked with the elongate body 100).

The piston spring retainer 206 can be an annular spring retainer configured for fixed attachment to the elongate body 100 of the suppressor 10. In some examples, a portion of the outer surface 228 of the piston spring retainer 206 may be configured for fixed attachment to the elongate body 100. In some examples, a portion of the outer surface 228 of the piston spring retainer 206 can be threaded such that the threads engage complementary threads formed on an inner diameter of the bore 112 proximate the bullet entry end 116 of the elongate body 100.

In some examples, the piston spring retainer 206 may have an inner diameter sized to correspond to the outer diameter of the piston 202, such that the piston spring retainer 206 can fit around the cylindrical body 208 of the piston 202 with close tolerance. In some examples, the piston spring retainer 206 can define a groove configured for receiving an O-ring 205 therein. In some examples, the piston spring retainer 206 can be formed without tabs and the like so that the piston spring retainer 206 can be free to rotate relative to the piston 202 and move longitudinally along the piston 202. In some examples, the piston spring retainer 206 can be rotatably coupled to the indexing ring 204. In such cases, the piston spring retainer 206 and the indexing ring 204 can be coupled to each other so that the piston spring retainer 206 can rotate relative to the indexing ring 204. Thus, after the indexing ring 204 and piston spring retainer 206 have been installed on the piston 202, the piston spring retainer 206 may be able to rotate both radially and move longitudinally relative to the piston 202 while being fixed radially and longitudinally relative to the elongate body 100 of the suppressor 10.

The piston assembly 200 may include a piston spring 230 positioned between the piston bullet entry end 210 and the piston bullet exit end 212. In another aspect, the piston spring 230 can be positioned on the exterior surface of the piston 202 therebetween the piston spring retainer 206 and a piston spring shoulder 232 that is formed on the piston bullet exit end 212. In still another aspect, the piston spring 230 can be configured to urge the indexing ring 204 longitudinally away from the piston bullet exit end 212. In use, the piston spring 230 can allow the elongate body 100 to move slightly independently of the piston 202 and the firearm, thereby aiding in unlocking of the firearm barrel.

The suppressor 10 may include the orientation assembly 300. The orientation assembly 300 may be configured to selectively prevent the elongate body 100 from rotating relative to the piston assembly 200. Thus, when the orientation assembly 300 is configured to prevent the elongate body 100 from rotating relative to the piston assembly 200, the piston assembly 200 may be fixedly attached to a firearm via rotation of the elongate body 100—e.g., by rotating the elongate body 100 so that threads on the inner diameter of the piston bullet entry end 210 of the piston 202 engage with mating threads of the barrel of the firearm. Based on fixedly attaching the piston assembly 200 to the firearm, the bullet entry end 116 may be positioned adjacent to the firing end of a barrel of the firearm.

In some examples, after the suppressor 10 is fixedly attached to the firearm, an orientation of the suppressor 10 may be in an undesirable orientation. Thus, when the orientation assembly 300 is configured to allow the elongate body 100 to rotate relative to the piston assembly 200, a position of the elongate body 100 may be moved to a desired orientation while a position the piston assembly 200 remains fixed—e.g., by rotating the elongate body 100 after fixedly attaching the piston assembly 200 to the elongate body 100.

In some examples, the orientation assembly 300 may include a cam lever that is used to urge a brake toward (or release a brake from) the outer surface 226 of the indexing ring 204. When the brake is in contact with the outer surface 226 of the indexing ring 204, the elongate body 100 may be prevented from rotating relative to the piston assembly 200. Alternatively, when the brake is separated from the outer surface 226 of the indexing ring 204, the elongate body 100 may be allowed to rotate relative to the piston assembly 200.

Although the cam lever and brake configuration may be successfully used to selectively prevent the elongate body 100 from rotating relative to the piston assembly 200, in some examples, urging the brake into contact with and releasing the brake from the outer surface 226 of the indexing ring 204 to prevent and allow rotation of the elongate body 100 may require excessive force from a user, among other issues. Also, in some examples, the brake may unintentionally release from the outer surface 226 of the indexing ring 204—e.g., as the cam lever wears out/loosens with repeated use, if the cam lever is not closed with sufficient force, etc. Accordingly, in some examples, the elongate body 100 may undesirably and unexpectedly rotate relative to the piston assembly 200 during use of the suppressor 10.

To facilitate an ability of a user to selectively lock the rotation of the elongate body 100 while extending the life and performance of the locking action, an alternative configuration for the orientation assembly 300 may be used. The alternative configuration of the orientation assembly 300 may include one or more pawls that can be selectively engaged with the outer surface 226 of the indexing ring 204 by toggling the selector component 350 (which may be a button, a wheel, or the like).

In some examples, the orientation assembly 300 may include one or more of the pawls 302, one or more of the pawl fasteners 304, and the selector component 350. One or more of the pawls 302 may be configured to engage with the outer surface 226 of the indexing ring 204 such that rotation of the elongate body 100 relative to the piston assembly 200 may be prevented when the one or more of the pawls 302 are engaged with the outer surface 226 of the indexing ring 204 and enabled when the one or more of the pawls 302 are disengaged from the outer surface 226 of the indexing ring 204. The pawls 302 (in combination with the selector component 350) may provide a link between the elongate body 100 and the piston assembly 200. The pawl fasteners 304 may be configured to attach the pawls 302 to the elongate body 100. For example, the pawl fasteners 304 may be configured to attach pawls 302 to an end of the back cap 104. Examples of the pawl fasteners 304 may be rivets, screws, nails, dowels, or the like.

The selector component 350 may be configured to (e.g., provide a link to) selectively engage the pawls 302 with the outer surface 226 of the indexing ring 204. In some examples, the selector component 350 may be a linear actuator or a rotary actuator that may be used to overcome a force applied to the pawls 302 that biases the pawls 302 in an engaged position with the outer surface 226 of the indexing ring 204. The force applied to the pawls 302 may be applied using one or more springs. The selector component 350 may be a button, a wheel, a lever, or any combination thereof.

By biasing the one or more pawls 302 in an engaged position with indexing ring 204, the one or more pawls 302 may be engaged with the indexing ring 204 in a normal state, and thus (relative to the cam lever configuration) a likelihood of the one or more pawls 302 unintentionally disengaging from the indexing ring 204 may be reduced as the operating life of the suppressor 10 increases. Also (relative to the cam lever configuration), by biasing the one or more pawls 302 in an engaged position with the indexing ring 204, the force for engaging the one or more pawls 302 with the indexing ring 204 may be shifted from the user. Additionally, the force with which the one or more pawls 302 are engaged with the indexing ring 204 may be more predictable and consistent during the operating life of the suppressor 10—e.g., based on the degree to which the one or more pawls 302 are biased. Moreover (relative to a cam lever configuration), by biasing the one or more pawls 302 in an engaged position with the indexing ring 204, the force for the user to disengage the one or more pawls 302 with the indexing ring 204 may be based on the degree to which the one or more pawls 302 are biased and, thus, more predictable and consistent for the user.

In some examples for assembling the suppressor 10, the piston assembly 200 may first be assembled by inserting the piston spring 230 around the piston 202 until the piston spring 230 is seated on the piston spring shoulder 232 of the piston 202. The at least one longitudinal indexing tab 218 of the indexing ring 204 may be aligned with the at least one longitudinal indexing groove 216 of the piston 202, and the indexing ring 204, the piston spring retainer 206, or both, may be slid onto the piston bullet entry end 210. This allows the indexing ring 204, the piston spring retainer 206, or both, to move longitudinally along the cylindrical body 208 of the piston 202, while preventing radial movement of the indexing ring 204.

The elongate body 100 may be formed from at least one of the elongate tube 102, the back cap 104, the front cap 106, the encapsulator 110, the blast baffle 108, and the chamber baffles 122. The piston assembly 200 can be inserted into the bore 112 of the elongate body 100, and the indexing ring 204 can be selectively fixedly attached to the elongate body 100 by, for example, engaging the threads on the outer diameter of the piston spring retainer 206 with the mating threads of the bore 112 of the elongate body 100.

The orientation assembly 300 may be assembled by attaching (using the pawl fasteners 304) the pawls 302 to a face of the back cap 104. The orientation assembly 300 may be further assembled by inserting the selector component 350 into an area for the selector component 350 such that the selector component 350 is coupled with the face of the back cap 104 and the pawls 302. In some examples the area for the selector component 350 is defined at least in part by an outer surface of the pawls 302, an orientation spring retainer, or both. In some examples, inserting the selector component 350 may include installing one or more springs for biasing the pawls 302 into an engaged position with the outer surface 226 of the indexing ring 204. In some examples, a cover for the components of the orientation assembly 300 may be attached to the back cap 104 to encapsulate and secure in position the components of the orientation assembly 300. After the orientation assembly 300 is attached to the elongate body 100, the pawls 302 may be biased into contact with the indexing ring 204, establishing a selective link between the elongate body 100 and the piston assembly 200.

Figure 2A:
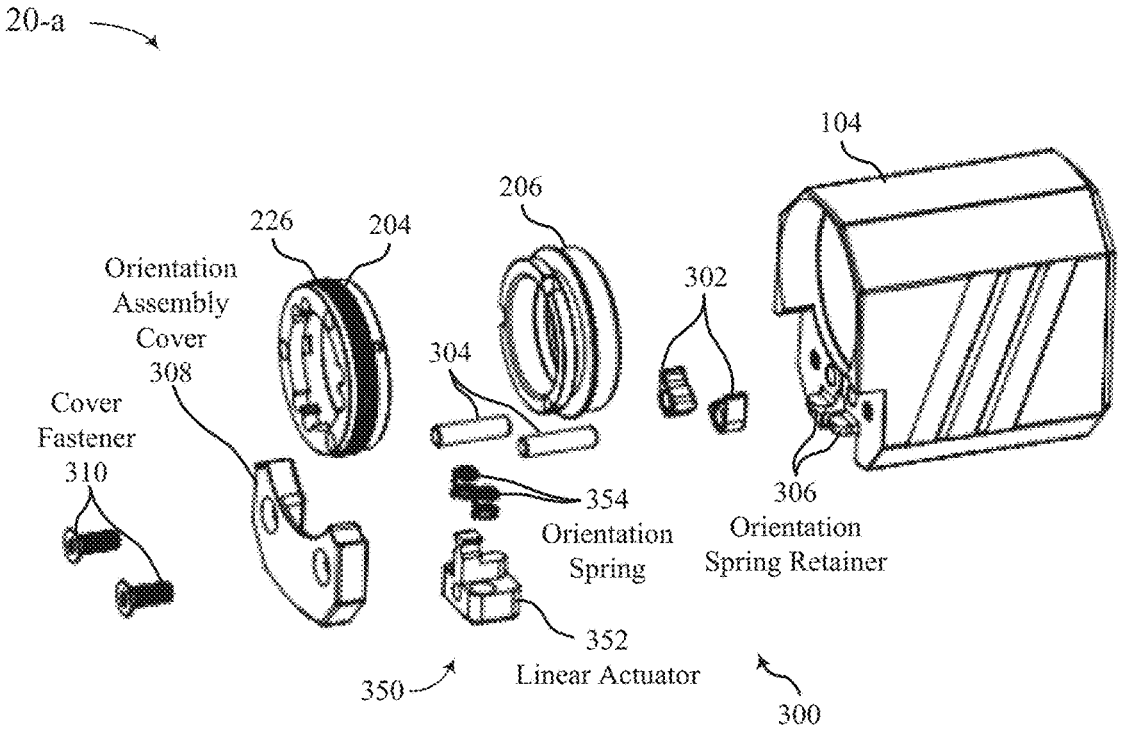
FIGS. 2A, 2B, and 2C show views of a suppressor in accordance with examples as disclosed herein.

FIG. 2A shows a view of a suppressor in accordance with examples as disclosed herein.

The component view 20-*a* shows a subset of the components of the suppressor 10 of FIG. 1. Particularly, the component view 20-*a* shows components of the suppressor 10 used to support the operation of the orientation assembly 300, including the back cap 104, the indexing ring 204, the piston spring retainer 206, and the components of the orientation assembly 300. The orientation assembly 300 may include the pawls 302, the pawl fasteners 304, the orientation spring retainer 306, the orientation assembly cover 308, the orientation assembly cover fasteners 310, the orientation springs 354, and the linear actuator 352.

The pawls 302 may be configured to be selectively engaged with the outer surface 226 of the indexing ring 204. When the pawls 302 are engaged with the outer surface 226 of the indexing ring 204, the elongate body may be prevented from rotating in either direction (clockwise or counterclockwise). When the pawls 302 are disengaged with the outer surface 226 of the indexing ring 204, the elongate body may be capable of rotating in either direction. The pawl fasteners 304 may be configured to attach the pawls 302 to the back cap 104. The pawl fasteners 304 may be rivets, screws, nails, dowels, or the like.

The linear actuator 352 may be configured to move in a linear direction toward and away from a longitudinal axis that extends from one end of the back cap 104 to the other end of the back cap 104. The linear actuator 352 may provide a link for selectively engaging the pawls 302 with the indexing ring 204. In some examples, the linear actuator 352 may be referred to as a button.

The orientation springs 354 may be configured to bias the pawls 302 into a position of engagement with the indexing ring 204. In some examples, the orientation springs 354 may be configured to bias the pawls 302 into a position of engagement with the indexing ring 204 separate from or in combination with the linear actuator 352 and the orientation spring retainer 306. That is, the orientation springs 354 may be positioned between a top surface of a base of the linear actuator 352 and a bottom surface the orientation spring retainer 306 such that the linear actuator 352 is biased away from the orientation spring retainer 306. As a result of the linear actuator 352 being biased away from the orientation spring retainer 306, a portion of the linear actuator 352 may engage with a portion of the pawls 302 that causes the pawls 302 to be engaged with the indexing ring 204, preventing the indexing ring 204 from rotating. When the linear actuator 352 is depressed with a force that overcomes the force of the orientation springs 354, the linear actuator 352 may be moved toward the orientation spring retainer 306. As a result of the linear actuator 352 being moved toward the orientation spring retainer 306, a second portion of the linear actuator 352 may engage with a second portion of the pawls 302 that causes the pawls 302 to disengage with the indexing ring 204, allowing the elongate body 100 to disengage from the indexing ring 204 and to rotate freely.

In some examples, one orientation spring 354 is used to bias the pawls 302. In other examples, more than one orientation spring 354 is used to bias the pawls 302—e.g., two, three, or four orientation springs may be used. Including orientation springs 354 at the four corners of the linear actuator 352 may maintain the base of the linear actuator 352 in a level orientation. In some examples, the selector component 350 includes one or more of the linear actuators 352, the orientation springs 354, and the orientation spring retainer 306.

The orientation assembly cover 308 may be used to cover the components of the orientation assembly 300 and to secure the components of the orientation assembly 300 in place—e.g., may prevent movement of the components of the orientation assembly 300 in undesired directions. The orientation assembly cover fasteners 310 may be used to attach the orientation assembly cover 308 to the back cap 104. The orientation assembly cover fasteners 310 may be rivets, screws, nails, dowels, or the like. In some examples, the orientation springs 354 may be positioned between the pawls 302 and the orientation assembly cover fasteners 310 to bias the pawls 302 to be engaged with the indexing ring 204. In some examples, the orientation springs 354 may be torsion springs.

Figure 2B:
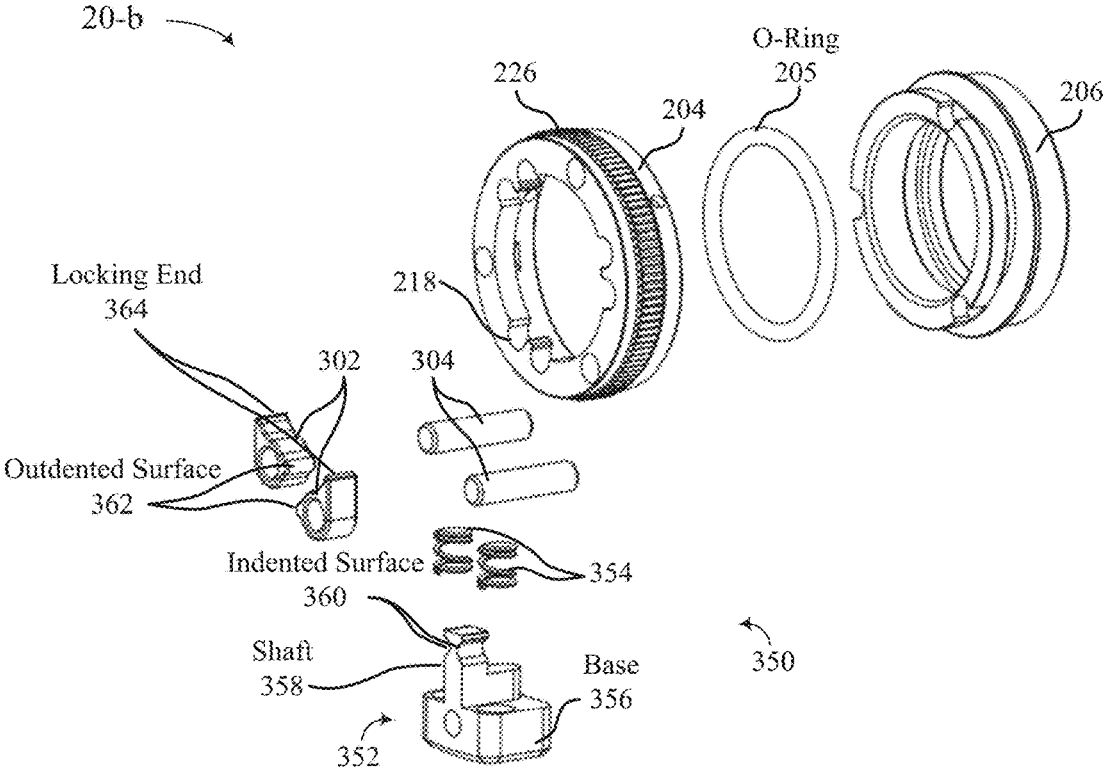

FIG. 2B shows a view of a suppressor in accordance with examples as disclosed herein.

The component view 20-*b* shows a subset of the components of the suppressor 10 of FIG. 1. Particularly, the component view 20-*b* shows (in increased detail) components of the suppressor 10 used to support the operation of the orientation assembly 300, including the indexing ring 204, the piston spring retainer 206, and the components of the orientation assembly 300. The orientation assembly 300 may include the pawls 302, the pawl fasteners 304, the orientation spring retainer 306, the orientation assembly cover 308, the orientation assembly cover fasteners 310, the orientation springs 354, and the linear actuator 352, as described with reference to FIG. 2B.

As shown in FIG. 2B, the linear actuator 352 may include a linear actuator base 356 and a linear actuator shaft 358. The linear actuator base 356 may provide a surface for compressing the orientation springs 354 against the surface of the orientation spring retainer 306. In some examples, the linear actuator base 356 may include depressions for housing at least a portion of an orientation spring. In some examples, the linear actuator base 356 may support the placement of four orientation springs 354.

Additionally, the linear actuator 352 may include a linear actuator shaft 358. The linear actuator shaft 358 may be configured to interact with the pawls 302 such that linear motion of the linear actuator shaft 358 causes rotational movement of the pawls toward or away from the indexing ring 204. Particularly, the linear actuator shaft 358 may include the indented surfaces 360 that are configured to interact with the outdented surfaces 362 of the pawls 302 such that when the linear actuator 352 is biased away from the orientation spring retainer 306, the locking ends 364 of the pawls are moved toward the outer surface 226 of the indexing ring 204. And when the linear actuator 352 is moved toward from the orientation spring retainer 306, the locking ends 364 of the pawls are moved away from the outer surface 226 of the indexing ring 204.

In some examples, the indexing ring 204 may be fastened to the piston spring retainer 206 using one or more pins. The one or more pins may be driven through one or more holes in the end of the indexing ring 204 that coupled with the end of the piston spring retainer 206. In some examples, the pins may be driven through the holes in the indexing ring 204 into a channel that extends around the end of the piston spring retainer 206, which may fix the indexing ring 204 to the spring retainer 206 while allowing the indexing ring 204 and the piston spring retainer 206 to rotate relative to one another.

Figure 2C:
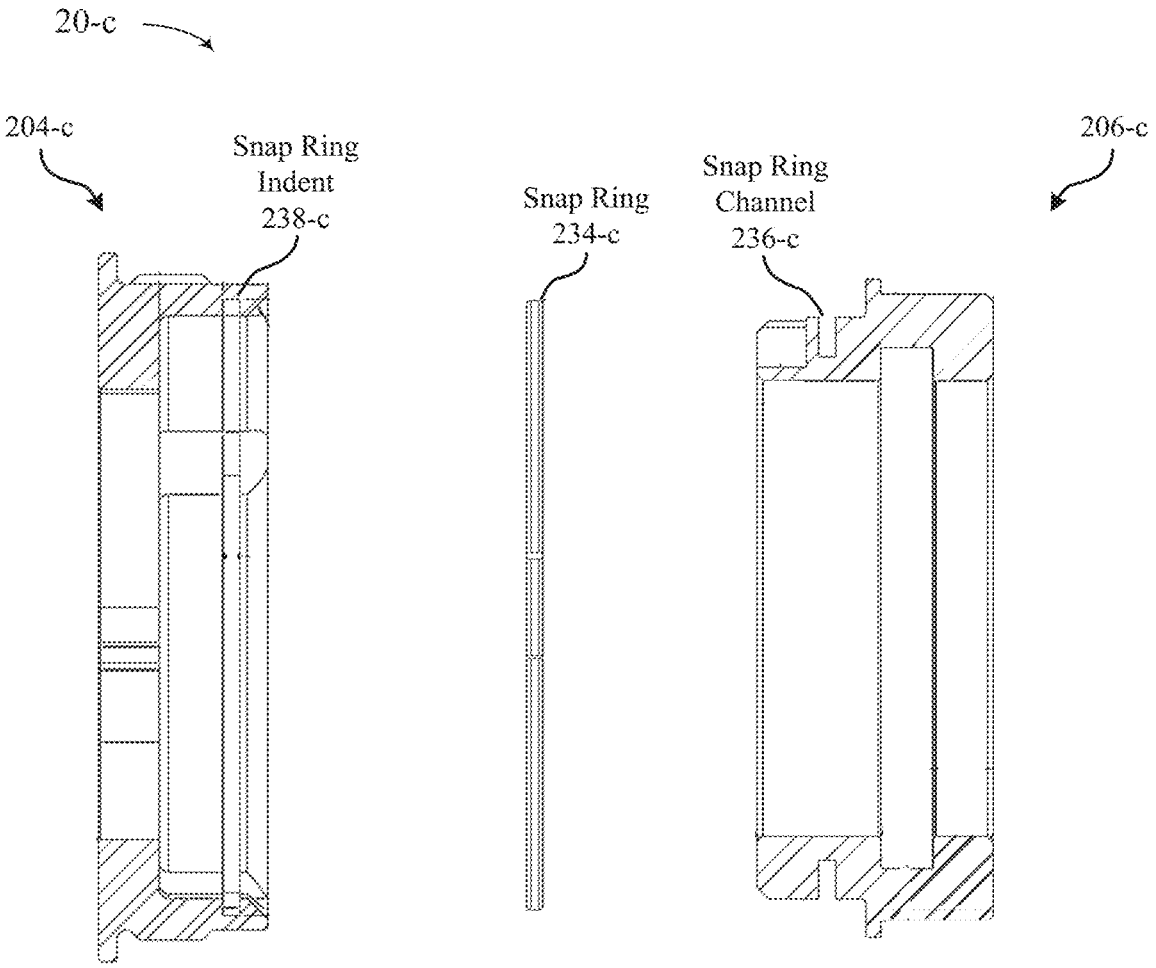

FIG. 2C shows a view of a suppressor in accordance with examples as disclosed herein.

The component view 20-*c* shows a subset of the components of the suppressor 10 of FIG. 1. Particularly, the component view 20-*c* shows an alternative (relative to FIG. 2B) implementation of the indexing ring 204 and the piston spring retainer 206, which are used to support the operation of the orientation assembly 300. As depicted in FIG. 2C, the indexing ring 204-*c* may be fastened to the piston spring retainer 206-*c* via the snap ring 234-*c*. In some examples, the indexing ring 204-*c* and the piston spring retainer 206-*c* may be implemented within the suppressor 10 depicted in FIG. 1—e.g., the indexing ring 204-*c* and the piston spring retainer 206-*c* may be used in place of the indexing ring 204 and the piston spring retainer 206 depicted in FIG. 1.

The indexing ring 204-*c* may include the snap ring indent 238-*c*, which may radially extend around the interior of the indexing ring 204-*c*. The snap ring indent 238-*c* may be configured to retain an outer portion of the snap ring 234-*c*.

The piston spring retainer 206-*c* may include the snap ring channel 236-*c*, which may radially extend around the interior of the piston spring retainer 206-*c*. The snap ring channel may be configured to retain an inner portion of the snap ring 234-*c*.

In some examples, the snap ring 234-*c* may be disposed within the snap ring channel 236-*c*. In such cases, the indexing ring 204-*c* may be pressed over the snap ring channel 236-*c* such that the snap ring 234-*c* may also be disposed within the snap ring indent 238-*c*. Pressing the indexing ring 204-*c* over the snap ring channel 236-*c* may fix the indexing ring 204-*c* to the spring retainer 206-*c* while allowing the indexing ring 204-*c* and the piston spring retainer 206-*c* to rotate relative to one another.

In some examples, using a snap ring configuration reduces an amount of time and increases an ease with which the indexing ring 204-*c* may be fixed to the piston spring retainer 206-*c* (e.g., relative to a configuration that uses pins to fix these components together).

Figure 2D:
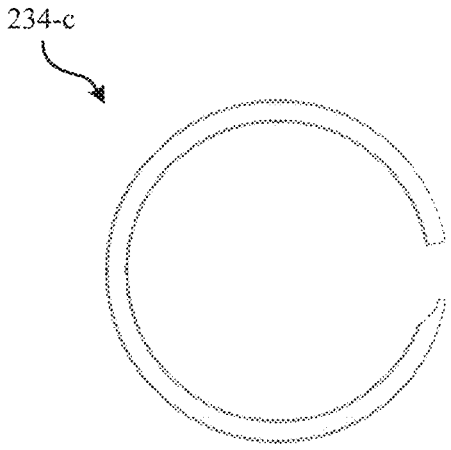
FIG. 2D shows a view of a snap ring in accordance with examples as disclosed herein.

FIG. 2D shows a view of a snap ring in accordance with examples as disclosed herein. In FIG. 2D, a view of the snap ring 234-*c* from a different direction (relative to FIG. 2C) is shown.

Figure 3A:
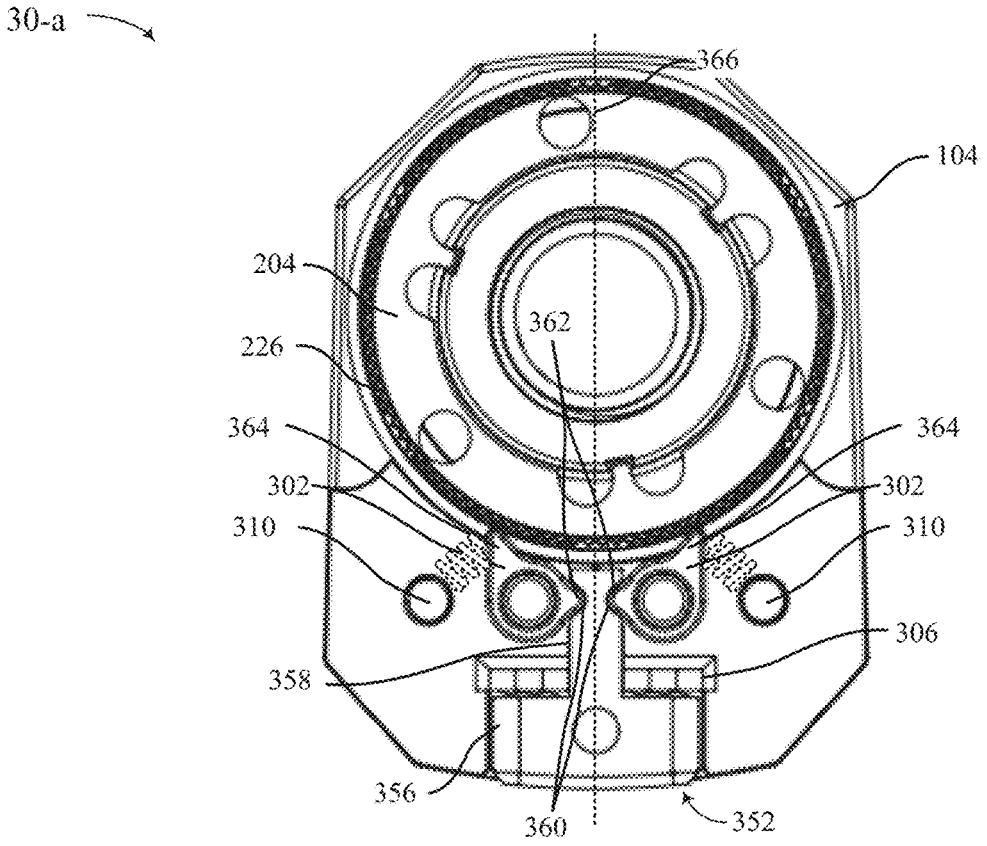
FIGS. 3A, 3B, and 4 show views of examples of an orientation assembly for a suppressor in accordance with examples as disclosed herein.

FIG. 3A shows a view of an example of an orientation assembly for a suppressor in accordance with examples as disclosed herein.

The view 30-*a* shows a front-facing view of the suppressor 10 of FIG. 1, where the suppressor 10 is assembled without the orientation assembly cover 308. As shown in FIG. 3A, the indented surfaces 360 of the linear actuator shaft 358 of the linear actuator 352 may interlock with the outdented surfaces 362 of the pawls 302. As described herein, the locking ends 364 of the pawls 302 may be biased toward the outer surface 226 of the indexing ring 204 (the center line 366 may pass through a center of the indexing ring 204). In some examples, orientation springs that are positioned between the linear actuator base 356 and the orientation spring retainer 306 may bias (through the linear actuator shaft 358) the locking ends 364 of the pawls 302 toward the outer surface 226 of the indexing ring 204. Additionally, or alternatively, orientation springs that are positioned between the locking ends 364 of the pawls 302 and the orientation assembly cover fasteners 310 may bias (e.g., directly) the locking ends 364 of the pawls 302 toward the outer surface 226 of the indexing ring 204—as shown by the dotted orientation springs.

When the linear actuator 352 is not being operated (and is flush with the exterior of the back cap 104 for example), the upper portion of the indented surfaces 360 of the linear actuator 352 may be pressed against the upper portion of the outdented surfaces 362 of the pawls 302—e.g., as a result of the biasing configuration. Accordingly, the pawls 302 may be caused to rotate inward toward the indexing ring 204, preventing rotation of the elongate body 100 relative to the piston assembly 200. When the linear actuator 352 is depressed (e.g., into the back cap 104), the lower portion of the indented surfaces 360 of the linear actuator 352 may be pressed against the lower portion of the outdented surfaces 362 of the pawls 302. Accordingly, the pawls 302 may be caused to rotate outward away from the indexing ring 204, allowing rotation of the elongate body 100 relative to the piston assembly 200. Thus, when the linear actuator 352 is in an inactive state, the pawls 302 may be biased into an engaged position with the indexing ring 204. And when the linear actuator 352 is in an active state (e.g., depressed), the pawls 302 may be moved into a disengaged position with the indexing ring 204.

By using the two pawls 302, the elongate body 100 may be securely attached to the piston assembly 200 while the pawls 302 are engaged with the indexing ring 204 and the rotational movement of the elongate body 100 may be reduced. Also, by using the two pawls 302, the suppressor 10 may be attached to barrels having right-handed threads or left-handed threads.

Figure 3B:
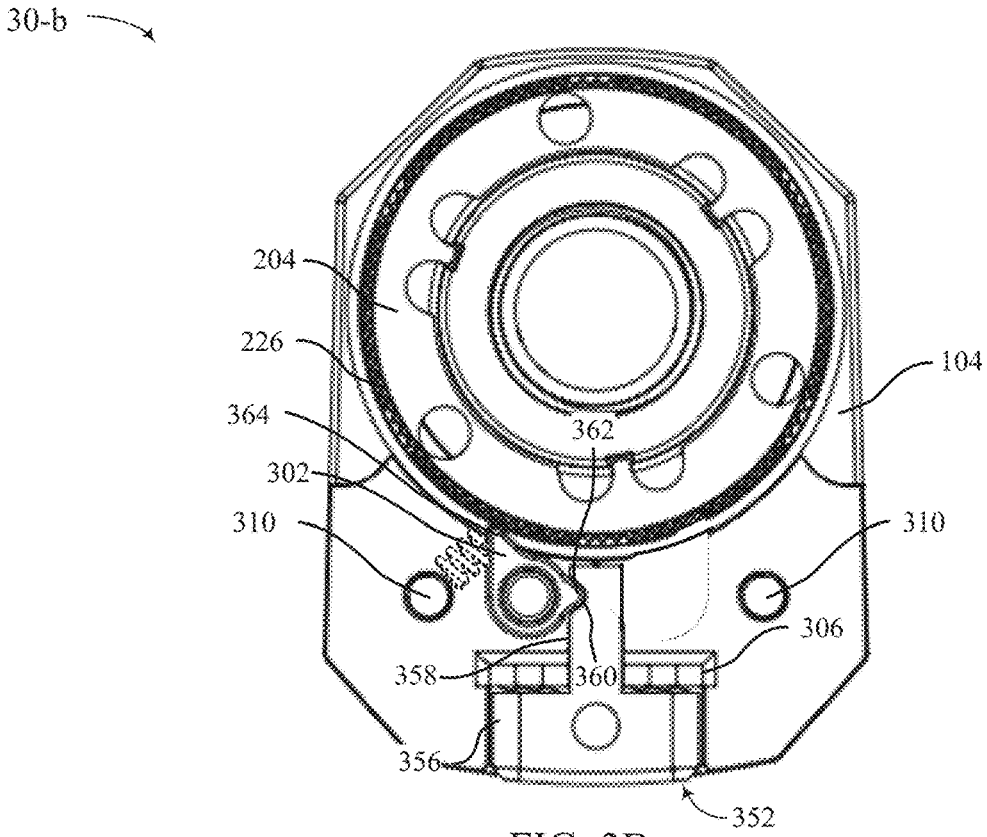

FIG. 3B shows a view of an example of an orientation assembly for a suppressor in accordance with examples as disclosed herein.

The view 30-*b* shows a front-facing view of the suppressor 10 of FIG. 1 where an alternative example of the orientation assembly 300 for the suppressor 10 includes the single pawl 302. When engaged with the indexing ring 204, the single pawl 302 may prevent rotation of the elongate body in one direction (e.g., the clockwise direction) while allowing rotation of the elongate body in the other direction (e.g., the counter-clockwise direction). When disengaged with the indexing ring 204, the single pawl 302 may allow rotation of the elongate body in either direction. By using a single pawl 302, a cost and complexity of the suppressor 10 may be reduced.

Figure 4:
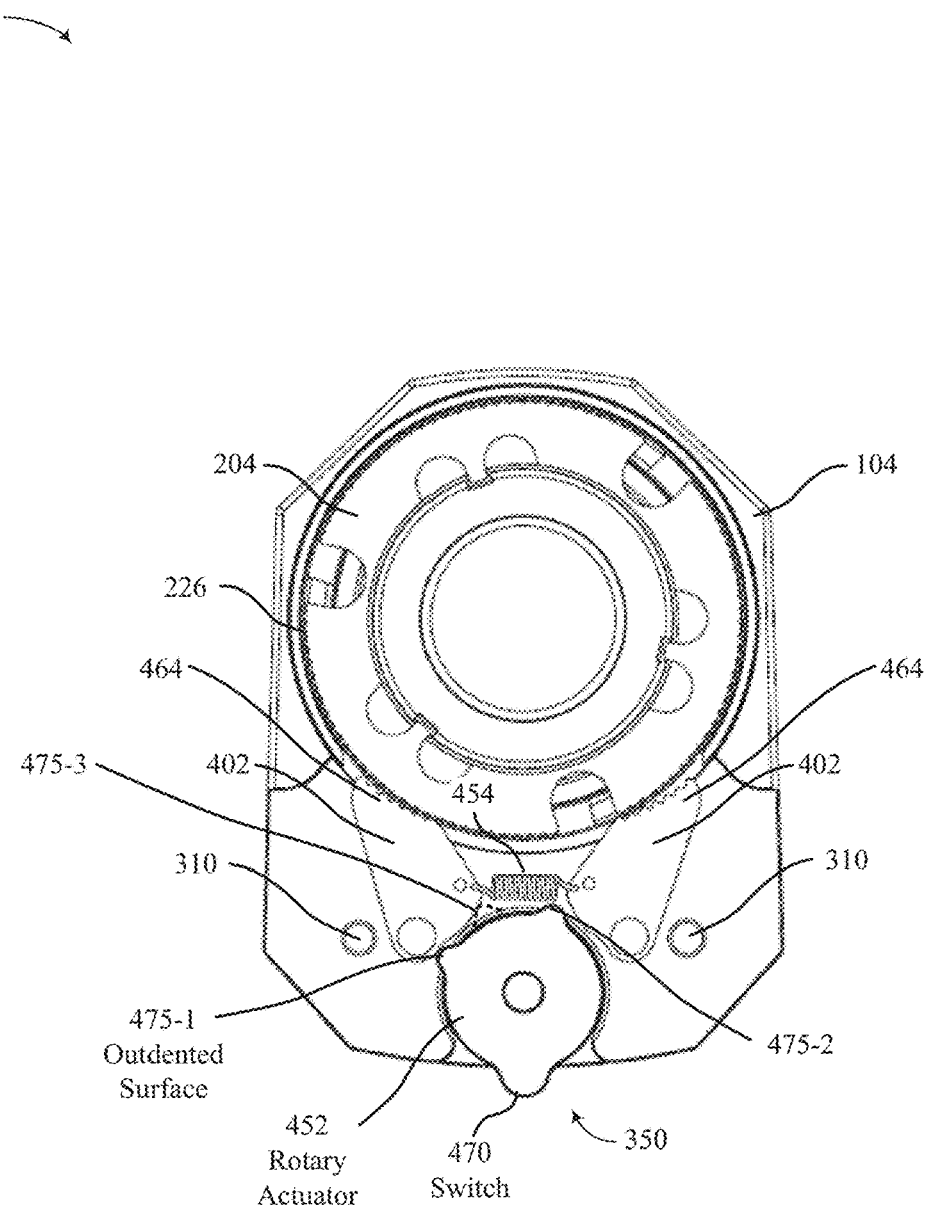

FIG. 4 shows a view of an example of an orientation assembly for a suppressor in accordance with examples as disclosed herein.

The view 40 shows a front-facing view of the suppressor 10 of FIG. 1 where an alternative example of the orientation assembly 300 for the suppressor 10 includes a rotary actuator 452 (which may also be referred to as a wheel) and a modified biasing configuration. The rotary actuator 452 may include a protrusion that forms the switch 470, first outdented surface 475-1, and second outdented surface 475-2. The modified biasing configuration may include the orientation spring 454 connected between the two pawls 402. In some examples, the pawls 402 may be configured similar to the pawls 302. The compressive force of the orientation spring 454 may cause the pawls 402 to be pulled toward one another such that the locking ends 464 of the pawls 402 may engage with the outer surface 226 of the indexing ring 204.

To disengage the pawls 402 from the indexing ring 204, the rotary actuator 452 may be rotated in a clockwise direction (e.g., by urging the switch 470 in a leftward direction) so that the first outdented surface 475-1 of the rotary actuator 452 and the second outdented surface 475-2 of the rotary actuator 452 may contact the outdented surfaces of the pawls 402, causing the pawls 402 to rotate away from the indexing ring 204. In some examples, the rotary actuator 452 may include a third outdented surface 475-3 (shown using dotted lines) configured to disengage one of the pawls 402 from the indexing ring 204—e.g., by urging the switch 470 in a rightward direction so that the third outdented surface contacts the outdented surface of the left pawl 402.

By using the configuration shown in FIG. 4, a single spring may be used to bias the pawls 402 toward the indexing ring 402. Also, in the configuration of FIG. 4, an alignment and installation of the switch 470 with the elongate body 100 may be facilitated relative to other configuration (e.g., without having to accommodate springs between the switch 470 and a spring retainer). Also, the configuration of the switch 470 may provide a robust option for the selector as the switch 470 may rotate around a single point.

Figure 5:
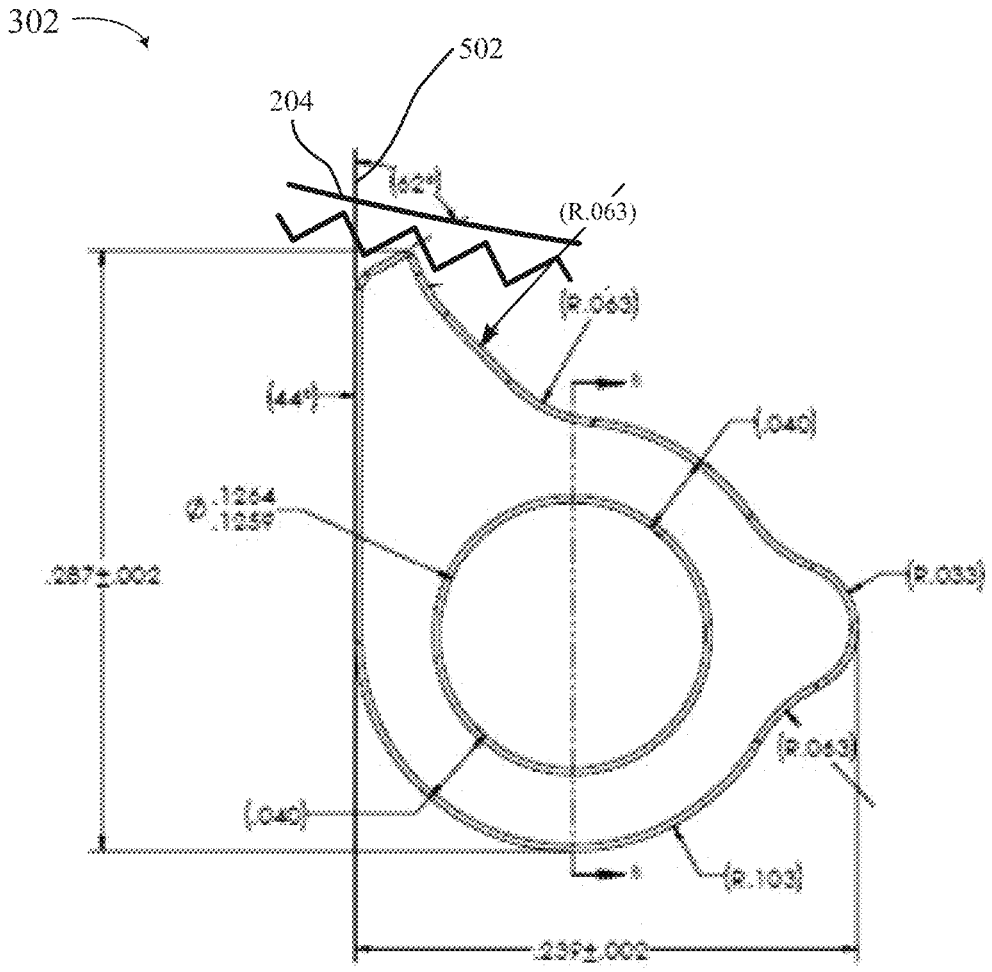
FIG. 5 shows an example of a pawl of an orientation assembly in accordance with examples as disclosed herein.

FIG. 5 shows an example of a pawl of an orientation assembly in accordance with examples as disclosed herein. The pawl 302 of the suppressor 10 may be configured to have the dimensions (or similar dimensions) shown in FIG. 5. In some examples, the pawl 302 may have dimensions that are within a percent range of the dimensions shown in FIG. 5 (e.g., plus or minus 10% of the stated dimensions). In some examples, the dimensions of the pawl 302 are configured to reduce an amount of backlash (which may also be referred to as play) between the locking end of the pawl 302 and the teeth of the outer surface 226 of the indexing ring 204.

As shown in FIG. 5, the pawl 302 may include a single tooth for engaging with the indexing ring 204. Including a single tooth on the pawl 302 may reduce manufacturing complexity and may secure the orientation assembly more strongly than a multiple tooth configuration. That is, the additional teeth of the multiple tooth configuration may act to push such pawls out and away from the indexing ring 204, reducing a security of the engagement of such pawls with the indexing ring 204. Additionally, the angle of the locking end of the pawl 302 (relative to the center line 366 that passes through the indexing ring) may be configured so that, as the pawl 302 rotates inward into position, the end of the pawl 302 is in the correct orientation to engage with the tooth of the indexing ring 204—e.g., so that the surface of the locking end is substantially parallel to the surface of the tooth that engages with the locking end of pawl 302. Accordingly, when engaged with the pawl 302, the angle of the tooth of the indexing ring 204 (relative to the center line 366) that engages with the locking end of the pawl 302 may be substantially equal to (e.g., the same as) the angle of the locking end of the pawl 302 (relative to the center line 366). In some examples, the angle of the locking end relative to the center line 366 (but shown with reference to the axis 502, which may be parallel to the center line 366) is sixty-two degrees. In some examples, the angle of the locking end relative to the axis 502 is between fifty-five and sixty-five degrees.

The dimensions of the pawl 302 are given as examples and may be changed without loss of operation. For example, the width and height of the pawl 302 may be changed to support differently sized suppressors, indexing rings, etc. Additionally, the angles and size of the outdented surface may be modified to be compatible with the indented surface of an actuator. Additionally, the angle of the locking end of the pawl 302 may be modified to be consistent with the angle of the teeth of the indexing ring 204 such that, when engaged with a tooth of the indexing ring 204, an angle of the surface of the locking end is substantially equal to the angle of the surface of the engaged tooth of the indexing ring 204.

Figure 6:
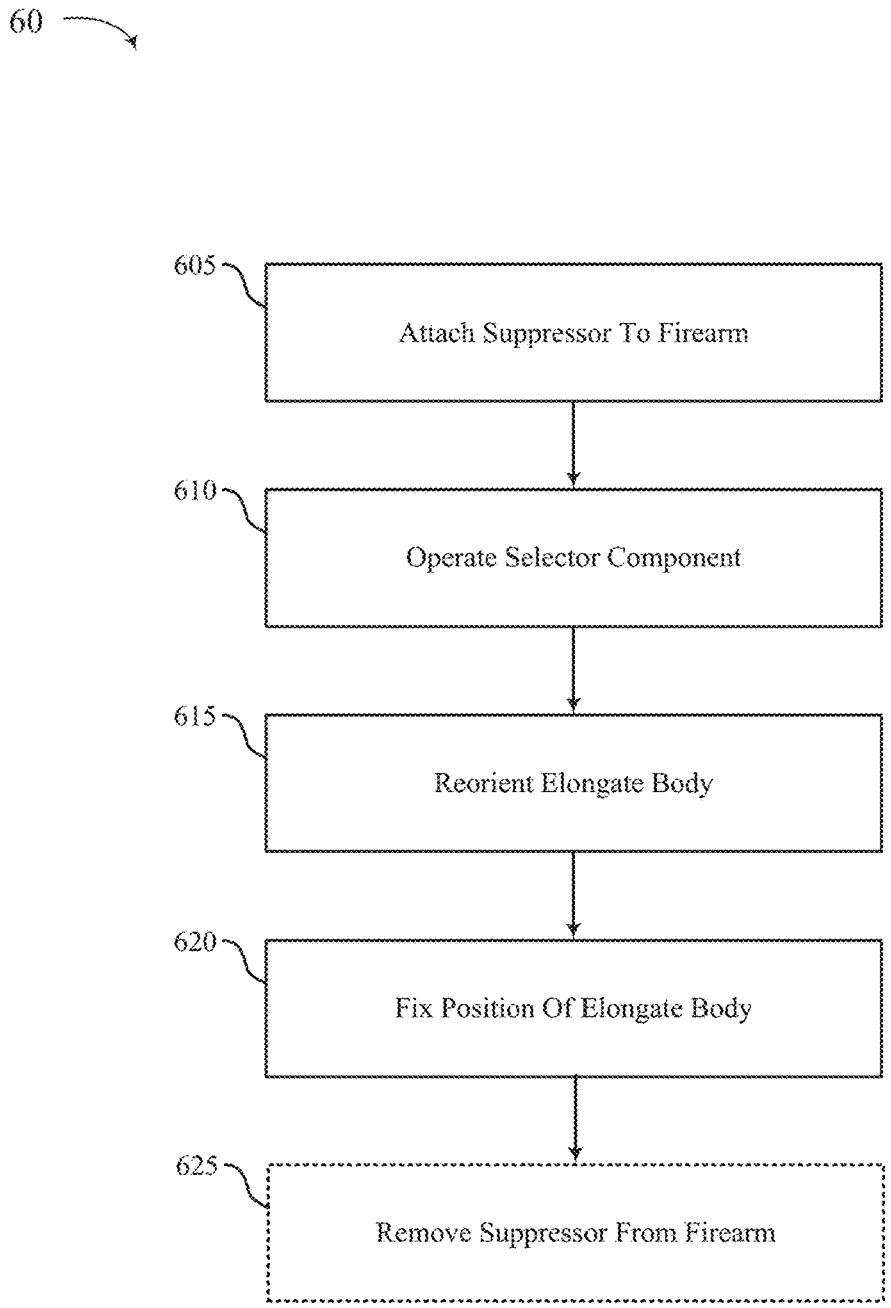
FIGS. 6 and 7 show example sets of operations for attaching a suppressor to a firearm in accordance with examples as disclosed herein.

FIG. 6 shows an example set of operations for attaching the suppressor to a firearm in accordance with examples as disclosed herein.

One or more of the operations described in the flowchart 60 may be performed earlier or later, omitted, replaced, supplemented, or combined with another operation. Also, additional operations described herein may replace, supplement or be combined with one or more of the operations described in the flowchart 60.

At 605, the suppressor 10 may be attached to a firearm. While attaching the suppressor 10 to the firearm, the pawls 302 may be engaged with the indexing ring 204 such that a position of the elongate body 100 is fixed relative to a position of the piston assembly 200. Accordingly, by rotating the elongate body 100, the piston assembly 200 may be fixedly attached to a barrel end of the firearm—e.g., by threading the threads of the piston 202 into complementary threads on the barrel of the firearm. As described herein, the pawls 302 of the suppressor 10 may be biased in an engaged position with the indexing ring 204—e.g., using one or more orientation springs. In some examples, after attaching the suppressor 10 to the firearm, the suppressor 10 may not be oriented in a desired orientation with respect to the connected firearm.

If the linear actuator 352 is used, while the suppressor 10 is attached to the firearm, the pawls 302 may be in an initial state and engaged with the indexing ring 204 by moving the linear actuator 352 toward a longitudinal axis of the suppressor 10. While the pawls 302 are in the initial state, the upper portion of indented surfaces of the linear actuator 352 may be pressed against the upper portion of outdented surfaces of the pawls 302, biasing the locking ends of the pawls 302 toward the indexing ring 204.

If the rotary actuator 452 is used, while the suppressor 10 is attached to the firearm, the pawls 302 may be engaged with the indexing ring 204 by moving the rotary actuator 452 to a first position (e.g., the position shown in FIG. 4). While the rotary actuator 452 is in the first position, the orientation spring 454 may bias the locking ends of the pawls 402 toward the indexing ring 204.

At 610, the selector component 350 of the suppressor 10 may be operated to disengage the pawls 302 from the indexing ring 204. If the linear actuator 352 is used, the pawls 302 may be disengaged from the indexing ring 204 by moving the linear actuator 352 toward a longitudinal axis of the suppressor 10—e.g., by depressing the linear actuator 352. While the linear actuator 352 is depressed, the bottom portion of the indented surfaces of the linear actuator 352 may be pressed against the bottom portion of the outdented surfaces of the pawls 302, moving the locking ends of the pawls 302 away from the indexing ring.

If the rotary actuator 452 is used, the pawls 402 may be disengaged from the indexing ring 204 by moving (using the switch 470) the rotary actuator 452 in a clockwise direction to a second position. While the rotary actuator 452 is in the second position, the outdented surfaces of the rotary actuator 452 may be pushed past outdented surfaces of the pawls such that a first outdented surface of the rotary actuator 452 moves a locking end of a corresponding pawl 402 away from the indexing ring and a second outdented surface of the rotary actuator 452 moves a locking end of a corresponding second pawl 402 away from the indexing ring.

At 615, the elongate body 100 may be reoriented in a desired orientation with respect to the connected firearm (while the selector component 350 is being operated and the pawls 302 are disengaged from the indexing ring 204). That is, the elongate body 100 may be rotated (in either direction) relative to a fixed position of the piston assembly 200 and the firearm so that the elongate body 100 is oriented in the desired orientation.

At 620, the elongate body 100 may be fixed in the desired orientation. To fix the elongate body 100 in the desired orientation, the selector component 350 may be operated to reengage the pawls 302 with the indexing ring 204 while the elongate body 100 is in the desired orientation. If the linear actuator 352 is used, the pawls 302 may be reengaged with the indexing ring 204 by moving the linear actuator 352 away from the longitudinal axis of the suppressor 10—e.g., by releasing the linear actuator 352. Thus, the pawls 302 may return to the initial, biased state.

If the rotary actuator 452 is used, the pawls 302 may be reengaged with the indexing ring 204 by moving the rotary actuator 452 in a counter-clockwise direction back to the first position.

Accordingly, by using an orientation assembly that includes one or more biased pawls, the suppressor 10 may be securely attached to the firearm and oriented in a desired orientation with minimal effort by the user with a low likelihood of a failure by the orientation assembly. Thus, the likelihood of the orientation of the suppressor 10 inadvertently changing during operation may also be reduced.

At 625, the suppressor 10 may be removed from the firearm. While removing the suppressor 10 from the firearm, the pawls 302 may be engaged with the indexing ring 204 such that a position of the elongate body 100 is fixed relative to a position of the piston assembly 200. Accordingly, by rotating the elongate body 100 in the reverse direction used to attach the suppressor 10 to the firearm, the piston assembly 200 may be removed from a barrel end of the firearm—e.g., by unthreading the threads of the piston 202 from the complementary threads on the barrel of the firearm. As described herein, the pawls 302 of the suppressor 10 may be biased in an engaged position with the indexing ring 204—e.g., using one or more orientation springs.

Figure 7:
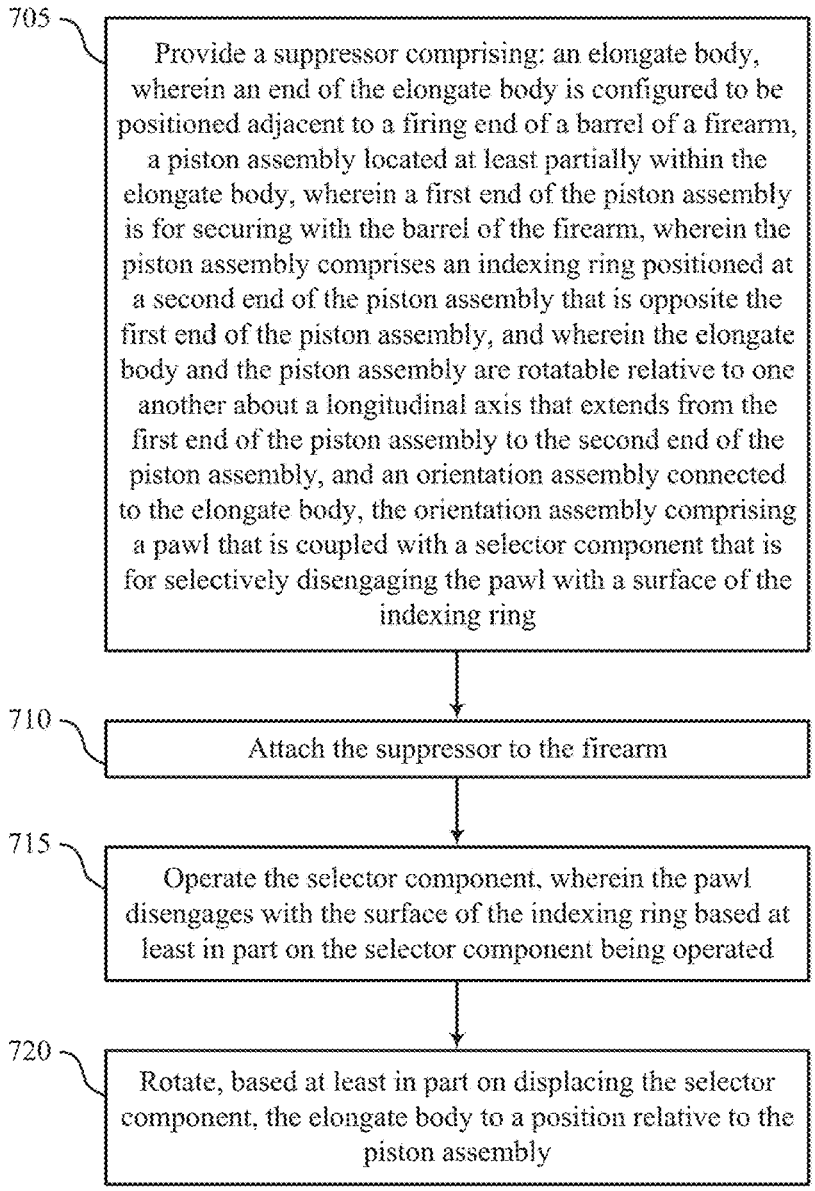

FIG. 7 shows a flowchart illustrating a method 70 that supports for attaching the suppressor to a firearm in accordance with examples as disclosed herein. The operations of method 70 may be implemented by a manufacturing system or user.

At 705, the method may include providing a suppressor including: an elongate body, where an end of the elongate body is configured to be positioned adjacent to a firing end of a barrel of a firearm, a piston assembly located at least partially within the elongate body, where a first end of the piston assembly is for securing with the barrel of the firearm, where the piston assembly includes an indexing ring positioned at a second end of the piston assembly that is opposite the first end of the piston assembly, and where the elongate body and the piston assembly are rotatable relative to one another about a longitudinal axis that extends from the first end of the piston assembly to the second end of the piston assembly, and an orientation assembly connected to the elongate body, the orientation assembly including a pawl that is coupled with a selector component that is for selectively disengaging the pawl with a surface of the indexing ring. The operations of 705 may be performed in accordance with examples as disclosed herein.

At 710, the method may include attaching the suppressor to the firearm. The operations of 710 may be performed in accordance with examples as disclosed herein.

At 715, the method may include operating the selector component, where the pawl disengages with the surface of the indexing ring based at least in part on the selector component being operated. The operations of 715 may be performed in accordance with examples as disclosed herein.

At 720, the method may include rotating, based at least in part on displacing the selector component, the elongate body to a position relative to the piston assembly. The operations of 720 may be performed in accordance with examples as disclosed herein.

In some examples, an apparatus as described herein may perform a method or methods, such as the method 70. The apparatus may include features, circuitry, logic, means, or instructions (e.g., a non-transitory computer-readable medium storing instructions executable by a processor), or any combination thereof for performing the following aspects of the present disclosure:

Aspect 1: A method, apparatus, or non-transitory computer-readable medium including operations, features, circuitry, logic, means, or instructions, or any combination thereof for providing a suppressor including: an elongate body, where an end of the elongate body is configured to be positioned adjacent to a firing end of a barrel of a firearm, a piston assembly located at least partially within the elongate body, where a first end of the piston assembly is for securing with the barrel of the firearm, where the piston assembly includes an indexing ring positioned at a second end of the piston assembly that is opposite the first end of the piston assembly, and where the elongate body and the piston assembly are rotatable relative to one another about a longitudinal axis that extends from the first end of the piston assembly to the second end of the piston assembly, and an orientation assembly connected to the elongate body, the orientation assembly including a pawl that is coupled with a selector component that is for selectively disengaging the pawl with a surface of the indexing ring; attaching the suppressor to the firearm; operating the selector component, where the pawl disengages with the surface of the indexing ring based at least in part on the selector component being operated; and rotating, based at least in part on displacing the selector component, the elongate body to a position relative to the piston assembly.

Aspect 2: The method, apparatus, or non-transitory computer-readable medium of aspect 1, where operating the selector component to selectively disengage the pawl with the surface of the indexing ring includes depressing the selector component toward the longitudinal axis and the method further includes releasing the selector component based at least in part on rotating the elongate body to the position.

Aspect 3: The method, apparatus, or non-transitory computer-readable medium of any of aspects 1 through 2, where the pawl is engaged with the surface of the indexing ring as the suppressor is attached to the firearm.

Aspect 4: The method, apparatus, or non-transitory computer-readable medium of any of aspects 1 through 3, where attaching the suppressor to the firearm includes securing the piston assembly to the barrel of the firearm.

It should be noted that the methods described herein describe possible implementations, and that the operations and the steps may be rearranged or otherwise modified and that other implementations are possible. Further, portions from two or more of the methods may be combined.

An apparatus is described. The following provides an overview of aspects of the apparatus as described herein:

Aspect 5: An apparatus, including: an elongate body (100), where an end (116) of the elongate body is configured to be positioned adjacent to a firing end of a barrel of a firearm; a piston assembly (200) located at least partially within the elongate body, where a first end (210) of the piston assembly is configured to be secured to the barrel of the firearm, where the piston assembly includes an indexing ring (204) positioned at a second end (212) of the piston assembly that is opposite the first end of the piston assembly, and where the elongate body and the piston assembly are rotatable relative to one another about a longitudinal axis that extends from the first end of the piston assembly to the second end of the piston assembly; and an orientation assembly (300) connected to the elongate body, the orientation assembly including a pawl (302, 402) and a selector component (350) that is configured to selectively disengage the pawl with a surface (226) of the indexing ring.

Aspect 6: The apparatus of aspect 5, where the surface of the indexing ring includes knurling, and the selector component is configured to selectively engage the pawl with the knurling of the indexing ring.

Aspect 7: The apparatus of any of aspects 5 through 6, where the pawl is configured to prevent the elongate body from rotating relative to the piston assembly in a first direction when engaged with the surface of the indexing ring.

Aspect 8: The apparatus of any of aspects 5 through 7, where the orientation assembly includes a second pawl (302, 402), the selector component is further configured to engage the second pawl with the surface of the indexing ring, and the pawl is configured to prevent the elongate body from rotating relative to the piston assembly in a first direction when engaged with the surface of the indexing ring and the second pawl is configured to prevent the elongate body from rotating relative to the piston assembly in a second direction when engaged with the surface of the indexing ring.

Aspect 9: The apparatus of any of aspects 5 through 8, where the orientation assembly includes a spring (354, 454) configured to bias a locking end of the pawl toward the surface of the indexing ring; and the selector component includes an actuator (352, 452), the orientation assembly configured to transfer a first force received at an input of the actuator to the pawl, where the actuator is configured to disengage the locking end of the pawl from the surface of the indexing ring when the first force received at the input of the actuator overcomes the bias of the spring.

Aspect 10: The apparatus of any of aspects 5 through 9, where the selector component includes a linear actuator (352) having a shaft (358), where an indented surface (360) of the shaft is interlocked with an outdented surface (362) of the pawl, the shaft is biased away from the longitudinal axis, a top portion of the indented surface of the shaft engages a top portion of the outdented surface of the pawl based at least in part on the shaft being biased away from the longitudinal axis, and a locking end (364) of the pawl engages the surface of the indexing ring based at least in part on the top portion of the indented surface of the shaft engaging the top portion of the outdented surface of the pawl.

Aspect 11: The apparatus of aspect 10, where the selector component further includes a base (356) connected to the shaft, the base is for biasing the shaft away from the longitudinal axis, and the base is further for linearly moving the shaft toward the longitudinal axis, where a bottom portion of the indented surface of the shaft is configured to engage a bottom portion of the outdented surface of the pawl when the shaft is moved toward the longitudinal axis.

Aspect 12: The apparatus of aspect 11, where the locking end of the pawl is configured to disengage the surface of the indexing ring based at least in part on the bottom portion of the indented surface of the shaft engaging the bottom portion of the outdented surface of the pawl.

Aspect 13: The apparatus of any of aspects 11 through 12, where the elongate body includes a spring retainer (306) that extends from the elongate body, and the orientation assembly further includes a spring (354) positioned between a surface of the spring retainer and an opposing surface of the base, where the shaft is biased away from the longitudinal axis based at least in part on a position of the spring.

Aspect 14: The apparatus of any of aspects 10 through 13, where the orientation assembly includes a second pawl (302), a second indented surface (360) of the shaft is opposite the indented surface of the shaft, the second indented surface of the shaft being interlocked with an outdented surface (362) of the second pawl, a top portion of the second indented surface of the shaft engages a top portion of the outdented surface of the second pawl based at least in part on the shaft being biased away from the longitudinal axis, and a locking end (364) of the second pawl engages the surface of the indexing ring based at least in part on the top portion of the second indented surface of the shaft engaging the top portion of the outdented surface of the second pawl.

Aspect 15: The apparatus of any of aspects 5 through 14, where the selector component includes a rotary actuator (452) with an outdented surface (475-1) that is interlocked with an indented surface of the pawl, a locking end (464) of the pawl is biased in an engaged position with the surface of the indexing ring, and a top portion of the outdented surface of the rotary actuator engages a top portion of the indented surface of the pawl based at least in part on the locking end of the pawl being biased to be engaged with the surface of the indexing ring.

Aspect 16: The apparatus of aspect 15, where the rotary actuator includes a second outdented surface (475-3) for rotating the rotary actuator, the top portion of the outdented surface is configured to engage with an outdented surface of the pawl when the rotary actuator is rotated in a first direction, and the pawl is configured to disengage from the surface of the indexing ring when the rotary actuator is rotated in the first direction.

Aspect 17: The apparatus of any of aspects 15 through 16, where the orientation assembly further includes: a second pawl (402) opposite the pawl, and a spring (454) that connects the pawl to the second pawl, the spring being configured to bias the locking end of the pawl and a locking end of the second pawl to be in the engaged position.

An apparatus is described. The following provides an overview of aspects of the apparatus as described herein:

Aspect 18: An assembly (300), including a pawl (302, 402) connected to an elongate body (100) of a firearm accessory for a firearm; a spring (354, 454) configured to bias the pawl to be in an engaged position with a surface of an indexing ring (204) of a piston assembly (200) disposed at least partially within the elongate body; and a selector component (350) configured to selectively disengage the pawl from the surface of the indexing ring to enable rotational movement of the elongate body relative to the piston assembly and about a firing axis of the firearm.

Aspect 19: The assembly of aspect 18, further including: a spring retainer (306) connected to the elongate body of the firearm accessory, where the spring (354) is positioned between the spring retainer and a base (356) of the selector component.

Aspect 20: The assembly of any of aspects 18 through 19, further including: a cover (308) configured to enclose the pawl, the spring, and the selector component, the cover attached to the elongate body using a fastener (310), where the spring is positioned between the fastener and the pawl.

Aspect 21: The assembly of any of aspects 18 through 20, further including: a second pawl (302, 402) connected to the elongate body, where the spring is configured to bias the second pawl to be in the engaged position with the surface of the indexing ring.

Aspect 22: The assembly of any of aspects 18 through 21, where the selector component includes: a shaft (358) configured to interact with the pawl; and a base (356) connected to the shaft and configured to provide a link for moving the shaft linearly.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the term "substantially" means that the modified characteristic (e.g., a verb or adjective modified by the term substantially) need not be absolute but is close enough to achieve the advantages of the characteristic.

As used herein, the terms "optional" or "optionally" mean that the subsequently described event or circumstance may or may not occur, and that the description includes instances where said event or circumstance occurs and instances where it does not.

The terms "if," "when," "based on," or "based at least in part on" may be used interchangeably. In some examples, if the terms "if," "when," "based on," or "based at least in part on" are used to describe a conditional action, a conditional process, or connection between portions of a process, the terms may be interchangeable.

The term "in response to" may refer to one condition or action occurring at least partially, if not fully, as a result of a previous condition or action. For example, a first condition or action may be performed, and a second condition or action may at least partially occur as a result of the previous condition or action occurring (whether directly after or after one or more other intermediate conditions or actions occurring after the first condition or action).

The description set forth herein, in connection with the appended drawings, describes example configurations and does not represent all the examples that may be implemented or that are within the scope of the claims. The term "exemplary" used herein means "serving as an example, instance, or illustration" and not "preferred" or "advantageous over other examples." The detailed description includes specific details to providing an understanding of the described techniques. These techniques, however, may be practiced without these specific details. In some instances, well-known structures and devices are shown in block diagram form to avoid obscuring the concepts of the described examples.

In the appended figures, similar components or features may have the same reference label. Further, various components of the same type may be distinguished by following the reference label by a hyphen and a second label that distinguishes among the similar components. If just the first reference label is used in the specification, the description is applicable to any one of the similar components having the same first reference label irrespective of the second reference label.

As used herein, including in the claims, "or" as used in a list of items (for example, a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

The description herein is provided to enable a person skilled in the art to make or use the disclosure. Various modifications to the disclosure will be apparent to those skilled in the art, and the generic principles defined herein may be applied to other variations without departing from the scope of the disclosure. Thus, the disclosure is not limited to the examples and designs described herein but is to be accorded the broadest scope consistent with the principles and novel features disclosed herein.

What is claimed is:

1. An apparatus, comprising:

an elongate body, wherein an end of the elongate body is configured to be positioned adjacent to a firing end of a barrel of a firearm;

a piston assembly located at least partially within the elongate body, wherein a first end of the piston assembly is configured to be secured to the barrel of the firearm, wherein the piston assembly comprises an indexing ring positioned at a second end of the piston assembly that is opposite the first end of the piston assembly, and wherein the elongate body and the piston assembly are rotatable relative to one another about a longitudinal axis that extends from the first end of the piston assembly to the second end of the piston assembly; and an orientation assembly connected to the elongate body, the orientation assembly comprising a first pawl, a second pawl, and a selector component that is configured to selectively disengage the first pawl and the second pawl with a surface of the indexing ring, wherein the first pawl is configured to prevent the elongate body from rotating relative to the piston assembly in a first direction when engaged with the surface of the indexing ring and the second pawl is configured to prevent the elongate body from rotating relative to the piston assembly in a second direction when engaged with the surface of the indexing ring.

2. The apparatus of claim 1, wherein:

the surface of the indexing ring comprises knurling, and the selector component is configured to selectively engage the first pawl with the knurling of the indexing ring.

3. The apparatus of claim 1, wherein:

the orientation assembly comprises a spring configured to bias a locking end of the first pawl toward the surface of the indexing ring; and the selector component comprises an actuator, the orientation assembly configured to transfer a first force received at an input of the actuator to the first pawl, wherein the actuator is configured to disengage the locking end of the first pawl from the surface of the indexing ring when the first force received at the input of the actuator overcomes the bias of the spring.

4. The apparatus of claim 1, wherein:

the selector component comprises a linear actuator having a shaft, wherein an indented surface of the shaft is interlocked with an outdented surface of the first pawl, the shaft is biased away from the longitudinal axis, a top portion of the indented surface of the shaft engages a top portion of the outdented surface of the first pawl based at least in part on the shaft being biased away from the longitudinal axis, and a locking end of the first pawl engages the surface of the indexing ring based at least in part on the top portion of the indented surface of the shaft engaging the top portion of the outdented surface of the first pawl.

5. The apparatus of claim 4, wherein:

the selector component further comprises a base connected to the shaft, the base is for biasing the shaft away from the longitudinal axis, and the base is further for linearly moving the shaft toward the longitudinal axis, wherein a bottom portion of the indented surface of the shaft is configured to engage a bottom portion of the outdented surface of the first pawl when the shaft is moved toward the longitudinal axis.

6. The apparatus of claim 5, wherein:

the locking end of the first pawl is configured to disengage the surface of the indexing ring based at least in part on the bottom portion of the indented surface of the shaft engaging the bottom portion of the outdented surface of the first pawl.

7. The apparatus of claim 5, wherein:

the elongate body comprises a spring retainer that extends from the elongate body, and the orientation assembly further comprises a spring positioned between a surface of the spring retainer and an opposing surface of the base, wherein the shaft is biased away from the longitudinal axis based at least in part on a position of the spring.

8. The apparatus of claim 4, wherein:

a second indented surface of the shaft is opposite the indented surface of the shaft, the second indented surface of the shaft being interlocked with an outdented surface of the second pawl, a top portion of the second indented surface of the shaft engages a top portion of the outdented surface of the second pawl based at least in part on the shaft being biased away from the longitudinal axis, and a locking end of the second pawl engages the surface of the indexing ring based at least in part on the top portion of the second indented surface of the shaft engaging the top portion of the outdented surface of the second pawl.

9. The apparatus of claim 1, wherein:

the selector component comprises a rotary actuator with an outdented surface that is interlocked with an indented surface of the first pawl, a locking end of the first pawl is biased in an engaged position with the surface of the indexing ring, and a top portion of the outdented surface of the rotary actuator engages a top portion of the indented surface of the first pawl based at least in part on the locking end of the first pawl being biased to be engaged with the surface of the indexing ring.

10. The apparatus of claim 9, wherein:

the rotary actuator comprises a second outdented surface for rotating the rotary actuator, the top portion of the outdented surface is configured to engage with an outdented surface of the first pawl when the rotary actuator is rotated in a first direction, and the first pawl is configured to disengage from the surface of the indexing ring when the rotary actuator is rotated in the first direction.

11. The apparatus of claim 9, wherein the orientation assembly further comprises:

a second pawl opposite the first pawl, and a spring that connects the first pawl to the second pawl, the spring being configured to bias the locking end of the first pawl and a locking end of the second pawl to be in the engaged position.

12. An assembly, comprising:

a first pawl connected to an elongate body of a firearm accessory for a firearm;

a second pawl connected to the elongate body of the firearm accessory;

one or more springs configured to bias the first pawl and the second pawl to be in an engaged position with a surface of an indexing ring of a piston assembly disposed at least partially within the elongate body; and a selector component configured to selectively disengage the first pawl and the second pawl from the surface of the indexing ring to enable rotational movement of the elongate body relative to the piston assembly and about a firing axis of the firearm.

13. The assembly of claim 12, further comprising:

a spring retainer connected to the elongate body of the firearm accessory, wherein a spring configured to bias the first pawl to be in the engaged position with the surface of the indexing ring is positioned between the spring retainer and a base of the selector component.

14. The assembly of claim 12, further comprising:

a cover configured to enclose the first pawl, the second pawl, the one or more springs, and the selector component, the cover attached to the elongate body using one or more fasteners, wherein the one or more springs are positioned between the one or more fasteners and the first pawl and the second pawl.

15. An assembly, comprising:

a first pawl connected to an elongate body of a firearm accessory for a firearm;

a spring configured to bias the first pawl to be in an engaged position with a surface of an indexing ring of a piston assembly disposed at least partially within the elongate body;

a second pawl connected to the elongate body, wherein the spring is configured to bias the second pawl to be in the engaged position with the surface of the indexing ring; and a selector component configured to selectively disengage the first pawl from the surface of the indexing ring to enable rotational movement of the elongate body relative to the piston assembly and about a firing axis of the firearm.

16. The assembly of claim 12, wherein the selector component comprises:

a shaft configured to interact with the first pawl; and a base connected to the shaft and configured to provide a link for moving the shaft linearly.

17. A method, comprising:

providing a suppressor comprising:

an elongate body, wherein an end of the elongate body is configured to be positioned adjacent to a firing end of a barrel of a firearm, a piston assembly located at least partially within the elongate body, wherein a first end of the piston assembly is for securing with the barrel of the firearm, wherein the piston assembly comprises an indexing ring positioned at a second end of the piston assembly that is opposite the first end of the piston assembly, and wherein the elongate body and the piston assembly are rotatable relative to one another about a longitudinal axis that extends from the first end of the piston assembly to the second end of the piston assembly, and an orientation assembly connected to the elongate body, the orientation assembly comprising a first pawl, a second pawl, and a selector component that is configured to selectively disengage the first pawl and the second pawl with a surface of the indexing ring, wherein the first pawl is configured to prevent the elongate body from rotating relative to the piston assembly in a first direction when engaged with the surface of the indexing ring and the second pawl is configured to prevent the elongate body from rotating relative to the piston assembly in a second direction when engaged with the surface of the indexing ring;

attaching the suppressor to the firearm;

operating the selector component, wherein the first pawl disengages with the surface of the indexing ring based at least in part on the selector component being operated; and rotating, based at least in part on displacing the selector component, the elongate body to a position relative to the piston assembly.

18. The method of claim 17, wherein:

operating the selector component to selectively disengage the first pawl and the second pawl with the surface of the indexing ring comprises depressing the selector component toward the longitudinal axis, and the method further comprises releasing the selector component based at least in part on rotating the elongate body to the position.

19. The method of claim 17, wherein the first pawl and the second pawl are engaged with the surface of the indexing ring as the suppressor is attached to the firearm.

20. The method of claim 17, wherein attaching the suppressor to the firearm comprises securing the piston assembly to the barrel of the firearm.

* * * * *